US009031455B2

(12) United States Patent
Watanabe

(10) Patent No.: US 9,031,455 B2
(45) Date of Patent: May 12, 2015

(54) IMAGE FORMING APPARATUS HAVING PIVOTABLE CASING

(71) Applicant: Yasunori Watanabe, Nagoya (JP)

(72) Inventor: Yasunori Watanabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/160,639

(22) Filed: Jan. 22, 2014

(65) Prior Publication Data

US 2014/0203694 A1 Jul. 24, 2014

(30) Foreign Application Priority Data

Jan. 22, 2013 (JP) ..... 2013-009559

(51) Int. Cl.

| | |
|---|---|
| ***G03G 15/00*** | (2006.01) |
| ***B41J 29/02*** | (2006.01) |
| ***E05F 1/12*** | (2006.01) |
| ***G03G 21/16*** | (2006.01) |
| ***B41J 29/13*** | (2006.01) |
| *A47B 95/02* | (2006.01) |
| *E05F 1/14* | (2006.01) |

(52) U.S. Cl.

CPC ..... *B41J 29/02* (2013.01); *E05F 1/1253* (2013.01); *E05Y 2201/21* (2013.01); *G03G 21/16* (2013.01); *G03G 2221/1687* (2013.01); *B41J 29/13* (2013.01)

(58) Field of Classification Search

USPC ..... 399/110, 125; 16/281

See application file for complete search history.

(56) References Cited

U.S. PATENT DOCUMENTS

| | | | | |
|---|---|---|---|---|
| 8,194,463 | B2 | 6/2012 | Kim et al. | |
| 2006/0029424 | A1 * | 2/2006 | Kawai et al. | 399/125 |
| 2006/0029425 | A1 * | 2/2006 | Tomatsu | 399/125 |
| 2010/0008149 | A1 | 1/2010 | Kim et al. | |
| 2011/0158680 | A1 * | 6/2011 | Koiwai | 399/110 |
| 2012/0141158 | A1 * | 6/2012 | Yamauchi | 399/110 |
| 2012/0155916 | A1 * | 6/2012 | Ito et al. | 399/110 |
| 2012/0163857 | A1 * | 6/2012 | Kamimura | 399/110 |
| 2012/0263493 | A1 * | 10/2012 | Okabe et al. | 399/110 |
| 2013/0121722 | A1 * | 5/2013 | Nakano | 399/110 |
| 2013/0164027 | A1 * | 6/2013 | Sato et al. | 399/110 |

FOREIGN PATENT DOCUMENTS

| | | | |
|---|---|---|---|
| JP | H08-54810 A | | 2/1996 |
| JP | 2006-229469 | * | 8/2006 |
| JP | 2008-304748 A | | 12/2008 |
| JP | 2010-020891 A | | 1/2010 |

* cited by examiner

*Primary Examiner* — Billy Lactaoen
*Assistant Examiner* — Arlene Heredia Ocasio
(74) *Attorney, Agent, or Firm* — Banner & Witcoff, Ltd.

(57) ABSTRACT

An image forming apparatus includes a first casing, a second casing, an arm, a guide unit, a support part, and an urging member. The second casing is supported on the first casing and configured to pivot relative to the first casing. The arm has a first end portion rotatably coupled to one of the first casing and the second casing and a second end portion slidably coupled to the other of the first casing and the second casing. The guide unit is provided at the other of the first casing and the second casing and configured to slidably guide a shaft. The guide unit includes a first guide and a second guide. The support part supports the first guide such that the first guide is movable toward and away from the second guide. The urging member is configured to urge the first guide toward the second guide.

14 Claims, 9 Drawing Sheets

IMAGE FORMING APPARATUS HAVING PIVOTABLE CASING

CROSS REFERENCE TO RELATED APPLICATION

This application claims priority from Japanese Patent Application No. 2013-009559 filed Jan. 22, 2013. The entire content of this priority application is incorporated herein by reference.

TECHNICAL FIELD

The present invention relates to an image forming apparatus having a first casing, and a second casing pivotably supported on the first casing.

BACKGROUND

One image forming apparatus known in the art is disclosed in Japanese Patent Application Publication No. 2008-304748, and includes a device body and a reading device for reading documents. The reading device is pivotably movable about a pivoting axis between a closed state in which the reading device is resting on the top surface of the device body and an open state in which the reading device is separated from the top surface of the device body. The device body includes a guide for guiding the pivotal movement of the reading device.

SUMMARY

The image forming apparatus further includes an arm having a one end portion rotatably coupled to the reading device and another end portion slidably coupled to the guide, and a coil spring for urging the other end portion of the arm toward the pivoting axis of the reading device so as to pull the other end portion of the arm. With this configuration, the coil spring pulls the other end portion of the arm toward the pivoting axis of the reading device when the reading device is pivoted from the closed state toward the open state, moving the arm from a horizontal orientation to a vertical orientation. In the vertical orientation, the arm holds the reading device in a state separated from the device body. Further, as the reading device is pivoted from the open state to the closed state, the other end portion of the arm moves toward the distal end of the reading device against the urging force of the coil spring, whereby the arm shifts from the vertical orientation to the horizontal orientation However, since the coil spring is stretched considerably far when the reading device is in the closed state in the image forming apparatus described above, a large urging force is exerted on the areas of the components supporting the coil spring. Consequently, the part of the device body on which the coil spring is mounted can become deformed.

Therefore, it is an object of the present invention to provide an image forming apparatus having a structure capable of minimizing deformation in the part of a first casing or a second casing pivotably mounted on the first casing at which an urging member is mounted.

According to an embodiment of the present invention, an image forming apparatus includes a first casing, a second casing, an arm, a guide unit, a support part, and an urging member. The second casing is supported on the first casing and configured to pivot relative to the first casing. The arm has a first end portion rotatably coupled to one of the first casing and the second casing and a second end portion slidably coupled to the other of the first casing and the second casing.

The second end portion has a shaft. The guide unit is provided at the other of the first casing and the second casing and configured to slidably guide the shaft. The guide unit includes a first guide and a second guide provided at a position opposite to the first guide relative to the shaft. The support part supports the first guide such that the first guide is movable toward and away from the second guide. The urging member is configured to urge the first guide toward the second guide.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 5:
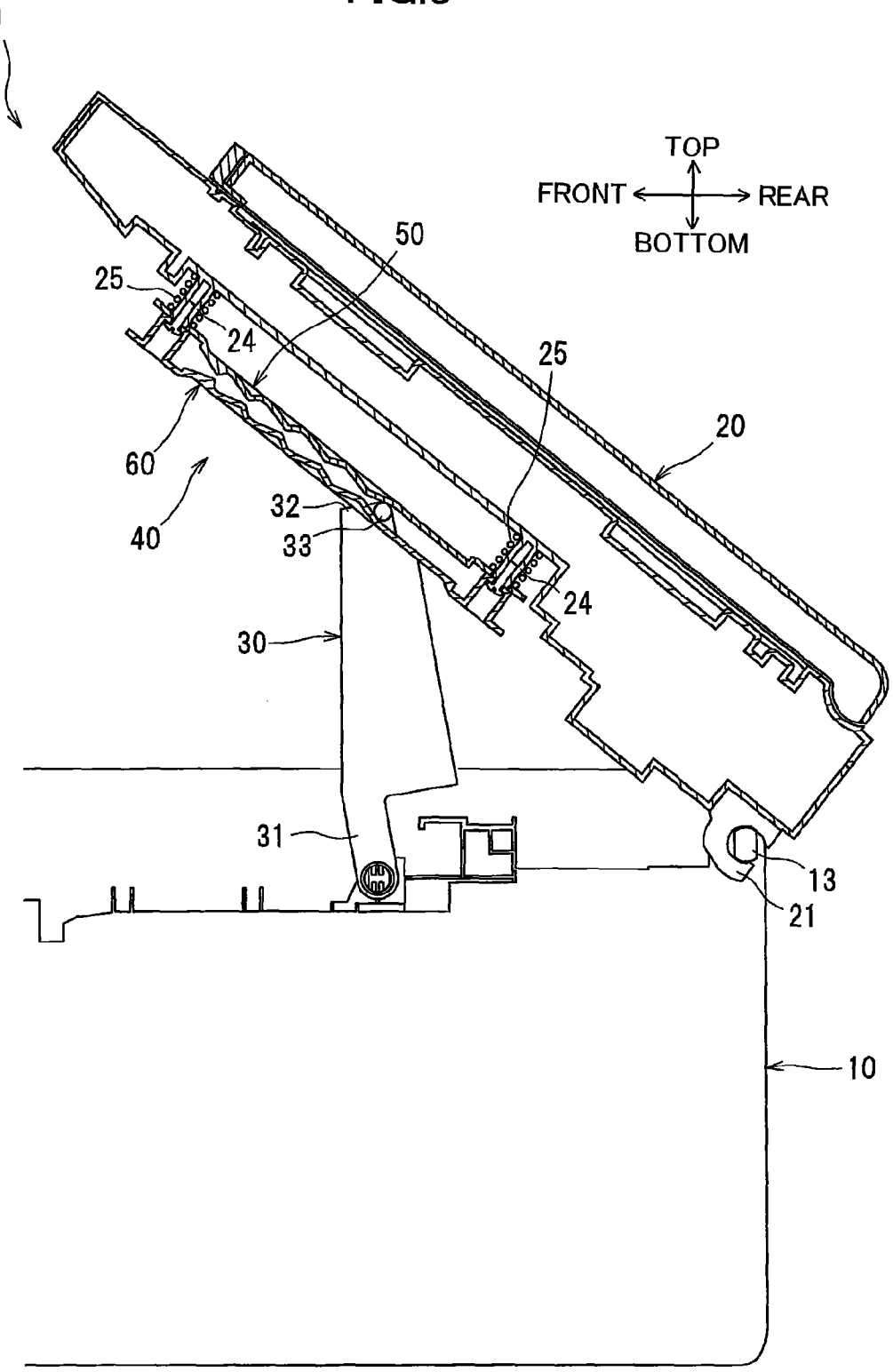
FIG. 5 is a cross-sectional view of the image forming apparatus in a state where the top casing is open.

Next, a multifunction peripheral 1 according to a preferred embodiment of the present invention will be described while referring to the accompanying drawings. Directions in the following description will be given based on the perspective of a user when using the multifunction peripheral 1. Specifically, the right side of the multifunction peripheral 1 in FIG. 5 is the "rear," the left side is the "front", the near side is the "right," and the far side is the "left." The top and bottom of the multifunction peripheral 1 based on the vertical direction in FIG. 5 will be called the "top" and "bottom."

Figure 1:
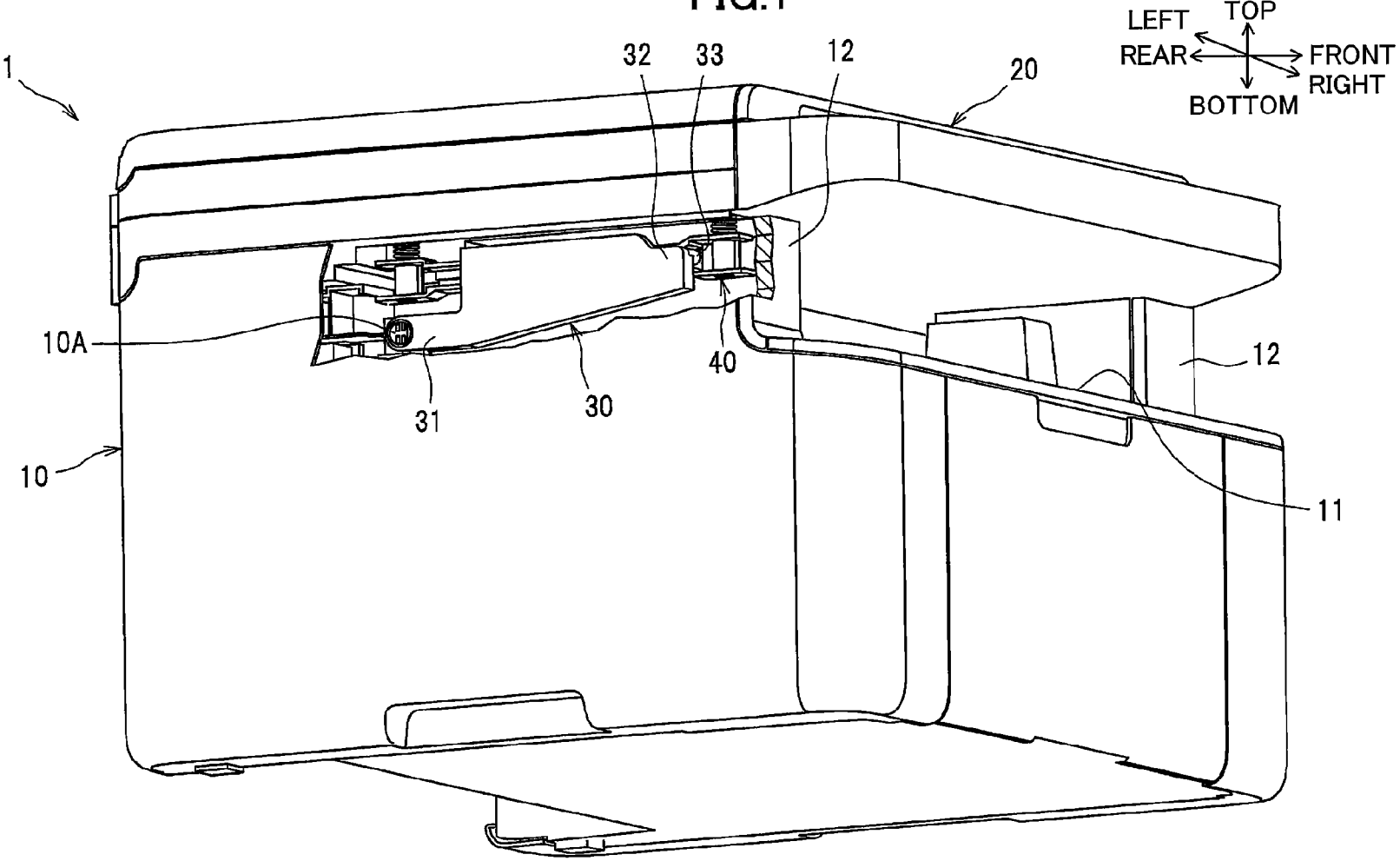
FIG. 1 is a schematic perspective view of an image forming apparatus according preferred embodiment of the present invention
Figure 2:
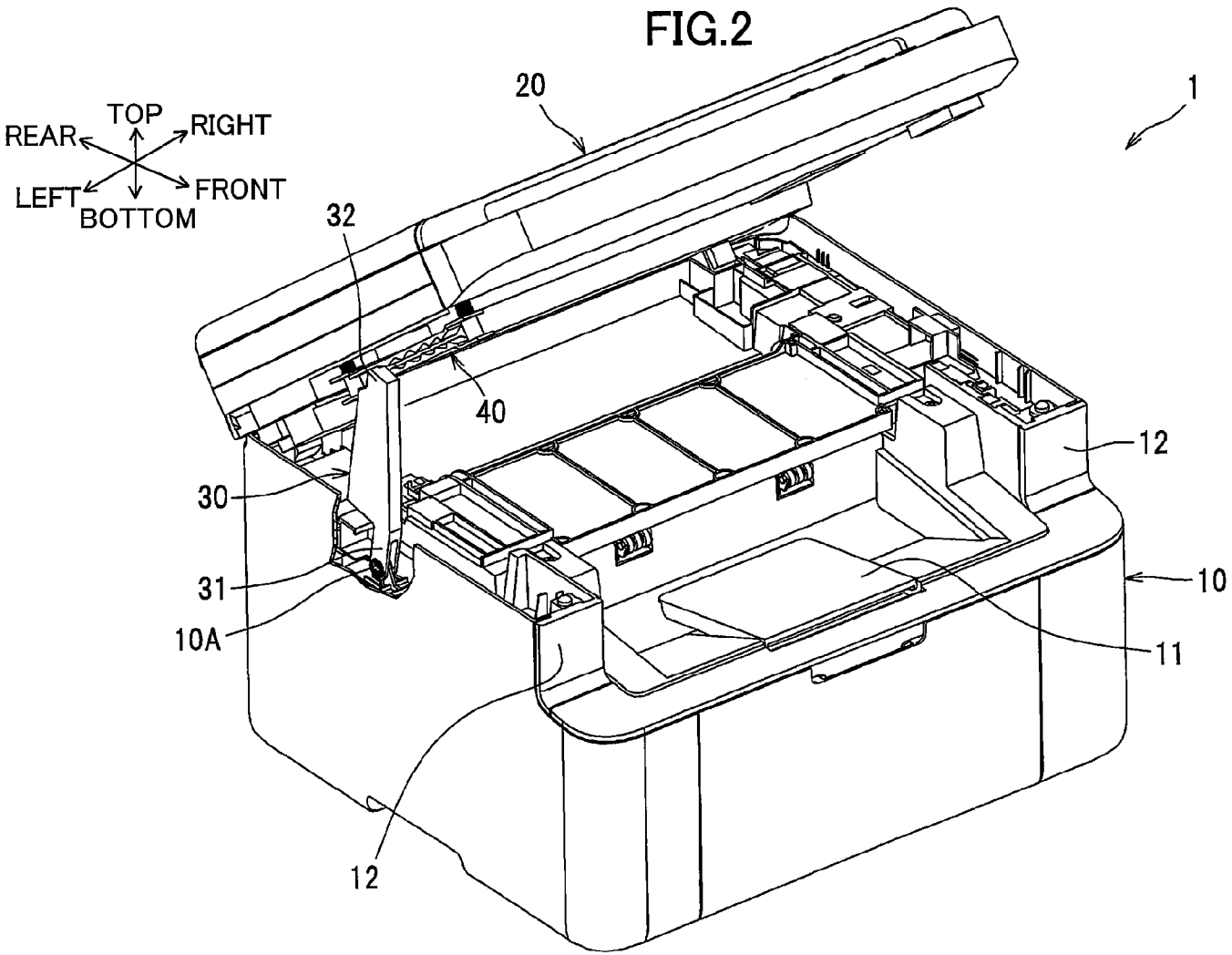
FIG. 2 is a schematic perspective view of the image forming apparatus in a state where a top casing is open.

As shown in FIGS. 1 and 2, the multifunction peripheral 1 includes a main casing 10 (as an example of a first casing), and a top casing 20 (as an example of a second casing) pivotably supported on the main casing 10 so as to be movable between a closed state and an open state.

The main casing 10 accommodates therein a sheet-feeding tray, a paper-conveying mechanism, and an image-forming unit. The main casing 10 has a top surface provided with a discharge tray 11 for receiving sheets discharged after the image-forming unit has formed images on the sheets. Two vertical wall sections 12 are provided on the front surface of the main casing 10, protruding upward from the discharge tray 11. One of the vertical wall sections 12 is provided on each of the left and right sides of the main casing 10. The left vertical wall section 12 is provided with an arm 30 therein adapted to support the top casing 20 in the open state.

The arm 30 is an elongated member having a first end portion 31 rotatably coupled to a shaft 10A provided on the main casing 10, and a second end portion 32 slidably coupled to the top casing 20. More specifically, the second end 32 has an inner right surface provided with an engaging shaft 33 protruding inward (rightward) therefrom. The top casing 20A is provided with a guide unit 40 for slidably supporting the engaging shaft 33.

The top casing 20 houses a flatbed type original-reading mechanism. As shown in FIG. 5, bearings 21 are provided on the rear end of the top casing 20. The bearings 21 are rotatably supported on a rotational shaft 13 provided on the main casing 10. The guide unit 40 described above is disposed on the top casing 20 at a position vertically aligned with the arm 30.

Figure 3:
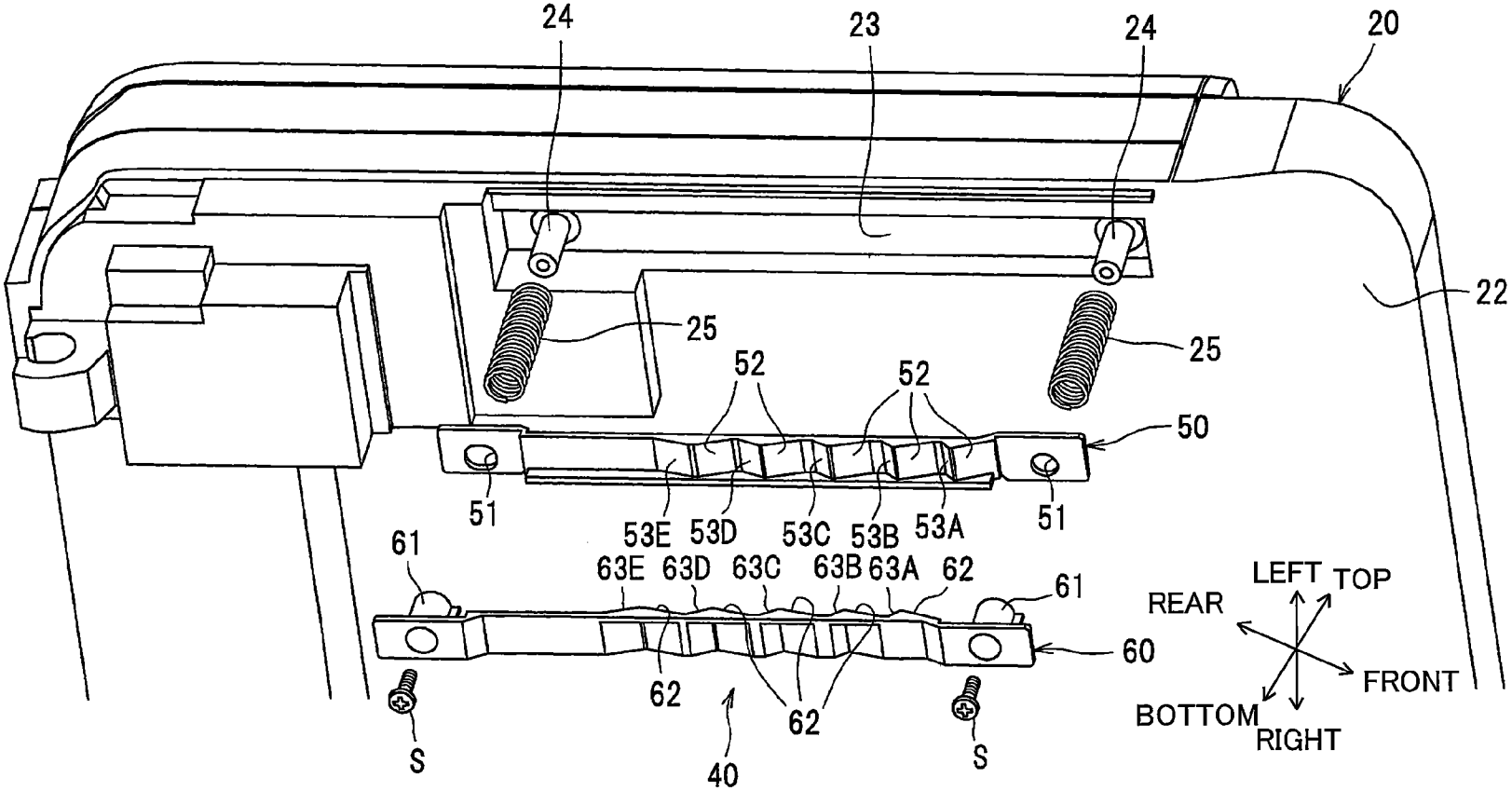
FIG. 3 is an exploded perspective view of a guide of the image forming apparatus.
Figure 4:
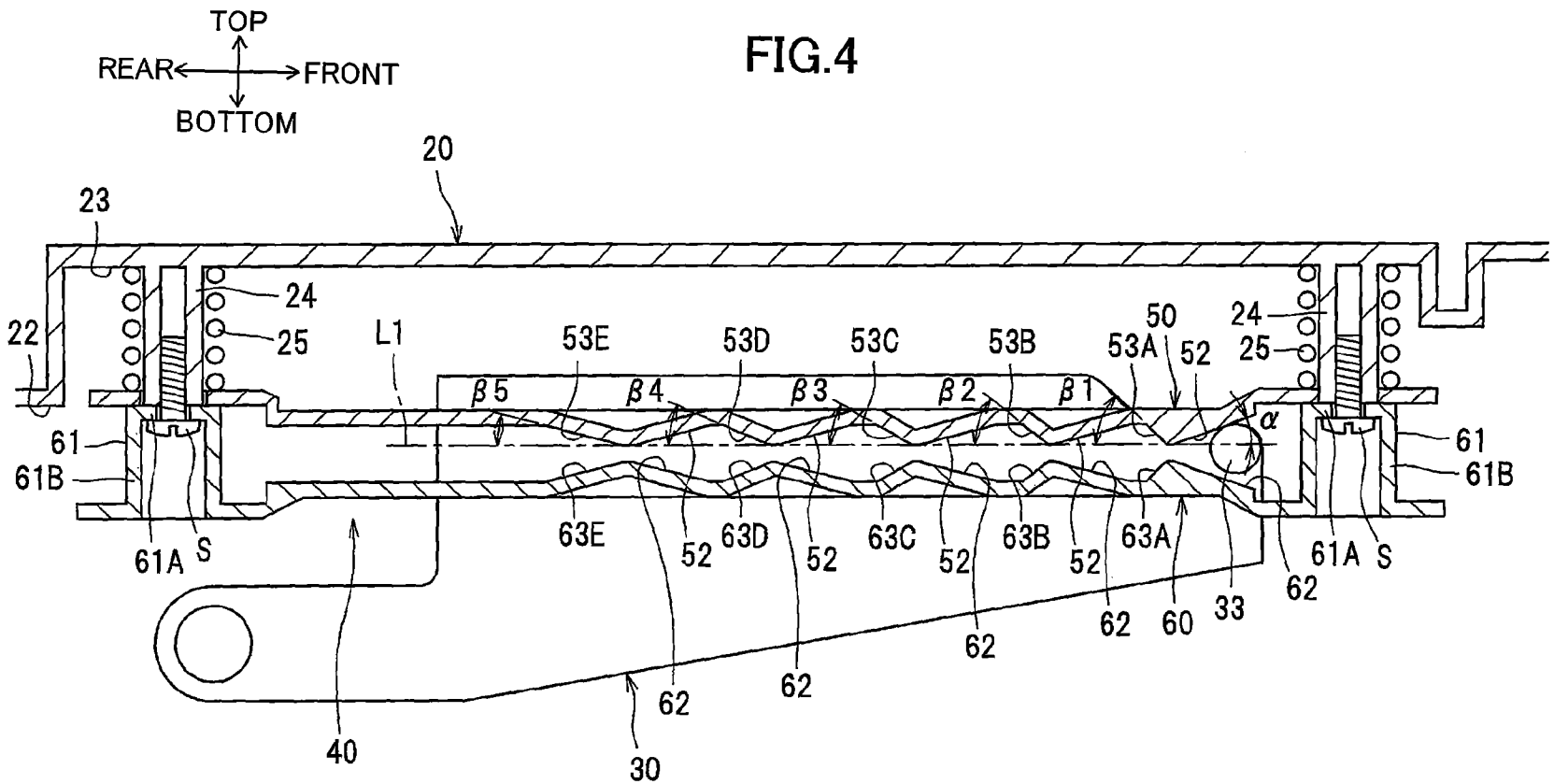
FIG. 4 is a cross-sectional view of the guide and an arm in a state where the top casing is closed.

As shown in FIGS. 3 and 4, the guide unit 40 has a first guide 50, and a second guide 60 disposed below the first guide 50, and specifically on the opposite side of the first guide 50 to interpose the engaging shaft 33 therebetween. The top casing 20 has a bottom surface 22 provided with a pair of front and rear protruding parts 24. More precisely, the protruding parts 24 are formed on a recessed bottom surface 23 recessed upward into the bottom surface 22. A pair of front and rear coil springs 25 is disposed between the bottom surface 23 and the first guide 50.

The second guide 60 is fixed to the distal ends of the two protruding parts 24. The first guide 50 is supported on the protruding parts 24 so as to be movable in the vertical direction in order to approach or separate from the second guide 60. The coil springs 25 urge the first guide 50 toward the second guide 60. In other words, the first guide 50 is movable along the protruding direction of the protruding parts 24, which is the direction that the first guide 50 opposes the second guide 60. Consequently, the coil springs 25 urge the first guide 50 in a direction different from the shaft moving direction in which the engaging shaft 33 of the arm 30 moves, and specifically orthogonal to the shaft moving direction.

By configuring the top casing 20 such that the coil springs 25 urge the first guide 50 toward the second guide 60, the deformation amount in the coil springs 25 is substantially constant whether the top casing 20 is in the open state or closed state. Therefore, this configuration suppresses deformation in the bottom surface 23 to which the coil springs 25 are attached.

Further, since the urging force of the coil springs 25, and specifically the degree of compression in the coil springs 25, is equivalent whether the top casing 20 is in the open state or the closed state, the urging force of the coil springs 25 does not become unnecessarily large while the user is operating the device or performing maintenance on the device. Hence, this configuration can suppress deformation in areas to which the coil springs 25 are attached.

The protruding parts 24 are more specifically formed in a cylindrical shape and protrude downward from the bottom surface 23, and the coil springs 25 are respectively mounted around the protruding parts 24. Hence, the protruding parts 24 support the coil springs 25 while movably supporting the first guide 50. Accordingly, the top casing 20 of the preferred embodiment has a simpler structure than a structure that has separately formed members for movably supporting the first guide and for supporting the coil springs, for example. By holding the coil springs 25 in a prescribed compressed state between the bottom surface 23 and the first guide 50, the coil springs 25 constantly urge the first guide 50 toward the second guide 60 fixed on the distal ends of the protruding parts 24.

The first guide 50 is a long plate-shaped member that is elongated in the front-rear direction, i.e., the direction from the proximal side to the distal side of the top casing 20. A through-hole 51 is formed in each end of the first guide 50, and five first sloped parts 52 are alternately juxtaposed with five second sloped parts 53A, 53B, 53C, 53D, and 53E between the through-holes 51. By inserting the protruding parts 24 through the through-holes 51 formed in the first guide 50, the protruding parts 24 support the first guide 50 so that the first guide 50 can move vertically.

The second guide 60 is an elongated plate-shaped member having a structure that is almost vertically symmetrical to the first guide 50. The second guide 60 has end portions each provided with a cylindrical protrusion 61 having a distal end face. Each cylindrical protrusion 61 includes a cylindrical part 61B protruding upward from the second guide 60 toward the first guide 50, and a top part 61A formed on the first guide 50 side of the cylindrical part 61B. The top part 61A is formed with a screw hole.

The second guide 60 is fastened to the distal ends of the protruding parts 24 by screws S inserted through the top parts 61A of the cylindrical protrusions 61. The top parts 61A have a larger diameter than the outer diameter of the cylindrical protruding parts 24. With this configuration, the portions of the top parts 61A that extend radially outside of the protruding parts 24 serve as restricting parts for restricting downward movement of the first guide 50. Thus, the preferred embodiment employs the second guide 60 in a simple structure for preventing the first guide 50 from slipping off the protruding parts 24.

The top parts 61A functioning as restricting members are reinforced by the cylindrical parts 61B, which extend downward from the peripheral edges of the top parts 61A. Through this structure, the top parts 61A can reliably receive the first guide 50 urged downward by the coil springs 25.

Between the cylindrical protrusions 61 provided on the front and rear ends of the second guide 60, the second guide 60 also includes five first sloped parts 62 alternately juxtaposed with five second sloped parts 63A, 63B, 63C, 63D, and 63E in the front-rear direction. The first sloped parts 62 and the second sloped parts 63A, 63B, 63C, 63D, and 63E are positioned to vertically confront the respective first sloped parts 52 and the second sloped parts 53A, 53B, 53C, 53D, and 53E of the first guide 50 described above, and have a general vertical symmetry with the same.

The first sloped parts 52 and 62 disposed at positions vertically opposite each other have sloped surfaces that slope in directions for reducing the gap between the first guide 50 and the second guide 60 toward the rear (toward the downstream side in the direction, as an example of a first direction, that the engaging shaft 33 slides within the guide unit 40 as the top casing 20 pivots upward). The vertical gap between the opposing first sloped parts 52 and 62 is smaller than the diameter of the engaging shaft 33. With this configuration, the first sloped parts 52 and 62 provides resistance to the engaging shaft 33 moving rearward as the bottom surface 22 pivotally moves upward.

Each of the second sloped parts 53A, 63A, . . . , 53E, and 63E is sloped to extend vertically outward from the rear end of the corresponding first sloped part 52 or 62. More specifically, each of the second sloped parts 53A, 63A, . . . , 53E, and 63E is connected to the rear end of the corresponding first sloped part 52 or 62 so as to form a corner having a predetermined angle. Each of the second sloped parts 53A, 63A, . . . , 53E, and 63E has a sloped surface sloping in a direction for narrowing the gap between the first guide 50 and the second guide 60 toward the front end (in the direction, as an example of a second direction opposed to the first direction, that the engaging shaft 33 slides within the guide unit 40 as the top casing 20 pivots downward). With this configuration, the vertically opposing second sloped parts 53A, 63A, . . . , 53E, and 63E provide resistance to the engaging shaft 33 moving forward as the top casing 20 pivots downward and are capable of holding the top casing 20 at the angle of the open state shown in FIG. 5, as well as at any one of five angles between the closed state and the open state.

The angles of the first sloped parts 52 and 62, and the second sloped parts 53A, 63A, . . . , 53E, and 63E are set as follows. Here, the angle of the sloped parts denotes an acute angle formed between the sloped part and the front-rear direction (specifically, a line L1 passing through the vertices of the five corners formed between the first sloped parts 52 and the respective second sloped parts 53A, 53B, 53C, 53D, and 53E) when the top casing 20 is in the closed state.

The angle of each first sloped part 52 on the first guide 50 is identical and set to an angle α. Similarly, the angle formed by each first sloped part 62 of the second guide 60 is set to the same angle α.

The angles formed by the second sloped parts 53A, 53B, 53C, 53D, and 53E of the first guide 50 are set to angles β1, β2, β3, β4, and β5 in order from front to rear. Similarly, the angles formed by the second sloped parts 63A, 63B, 63C, 63D, and 63E of the second guide 60 are set to the same angles β1, β2, β3, β4, and β5 in order from front to rear (see FIG. 4).

The angles α and β1, β2, β3, β4, and β5 have the following relationships.

$$\beta 1>\beta 2>\beta 3>\beta 4>\beta 5$$

$$\alpha=\beta 5$$

Thus, the angles β1, β2, β3, and β4 formed by the four pairs of second sloped parts 53A, 63A, . . . , 53D, and 63D on the front side are greater than angle a formed by the first sloped parts 52 and 62. If the angle α of the forwardmost first sloped parts 52 and 62 is called a first angle, then the angle β1 of the forwardmost second sloped parts 53A and 63A constitutes a second angle greater than the first angle. The succeeding sloped parts positioned second through fourth from the front have a similar relationship.

Setting the angle α of the first sloped parts 52 and 62 to a small value can reduce the force of resistance that the first sloped parts 52 and 62 apply to the engaging shaft 33 when the engaging shaft 33 moves rearward as the top casing 20 is pivoted upward. Accordingly, the top casing 20 can be pivoted upward with little effort. Similarly, setting the angles β1, β2, β3, and Γ4 of the respective second sloped parts 53A, 53B, 53C, and 53D to large values can increase the force of resistance that the second sloped parts 53A, 53B, 53C, and 53D apply to the engaging shaft 33 when the engaging shaft 33 moves forward as the top casing 20 is pivoted downward. Accordingly, this greater resistance prevents the top casing 20 from impacting the main casing 10 with great force.

Further, since the angles β1, β2, β3, β4, and β5 for the second sloped parts 53A, 63A, . . . , 53E, and 63E, respectively, are made gradually larger from the rear side toward the front side, the force of resistance that the second sloped parts 53A, 63A, . . . , 53E, and 63E apply to the engaging shaft 33 gradually increases as the top casing 20 pivots downward from the open state. Accordingly, the user can operate the top casing 20 with greater comfort and confidence than if the force of resistance were to increase abruptly.

Next, the function of the guide unit 40 when the top casing 20 is opened and closed on the main casing 10 will be described. As shown in FIGS. 4 and 5, when the top casing 20 is pivoted from the closed state shown in FIG. 4 to the open state shown in FIG. 5, the engaging shaft 33 passes rearward through the guide unit 40 from the front end of the same. As the engaging shaft 33 passes from the front end of each first sloped part 52 to the rear end of the same, the engaging shaft 33 pushes each first sloped part 52 upward, forcing the first guide 50 upward against the urging force of the coil springs 25. As the engaging shaft 33 leaves the rear end of each first sloped part 52, the urging force of the coil springs 25 moves the first guide 50 back downward.

Conversely, the engaging shaft 33 passes forward through the guide unit 40 from the rear end of the same as the top casing 20 is pivoted from the open state to the closed state. As the engaging shaft 33 passes from the rear end of each second sloped parts 53A, 53B, 53C, 53D, and 53E to the front end of the same, the engaging shaft 33 pushes the respective second sloped parts 53A, 53B, 53C, 53D, and 53E upwards, lifting the first guide 50 upward against the urging force of the coil springs 25. As the engaging shaft 33 leaves the front end of the respective second sloped parts 53A, 53B, 53C, 53D, and 53E, the urging force of the coil springs 25 move the first guide 50 back downward.

The up and down stroke of the first guide 50 can be kept to a minimal length corresponding to the size of the engaging shaft 33 and the vertical gap formed between the sloped parts. Hence, the amount of deformation in the coil springs 25 can be reduced to a much smaller amount than the deformation in the conventional urging member that applies an urging force in substantially the same direction that the shaft of the arm moves. Therefore, the structure of the preferred embodiment better suppresses deformation in the parts to which the coil springs 25 are attached.

In addition to the effects described above, the multifunction peripheral 1 according to the preferred embodiment can achieve the following effects. By fixing the second guide 60 to the top casing 20, the preferred embodiment achieves a simpler structure than a variation that will be described later in which both the first and second guides are capable of moving, for example.

While the invention has been described in detail with reference to specific embodiments thereof, it would be apparent to those skilled in the art that many modifications and variations may be made therein without departing from the spirit of the invention, the scope of which is defined by the attached claims. In the following description of a variation of the embodiment, like parts and components are designated with the same reference numerals to avoid duplicating description.

Figure 6:
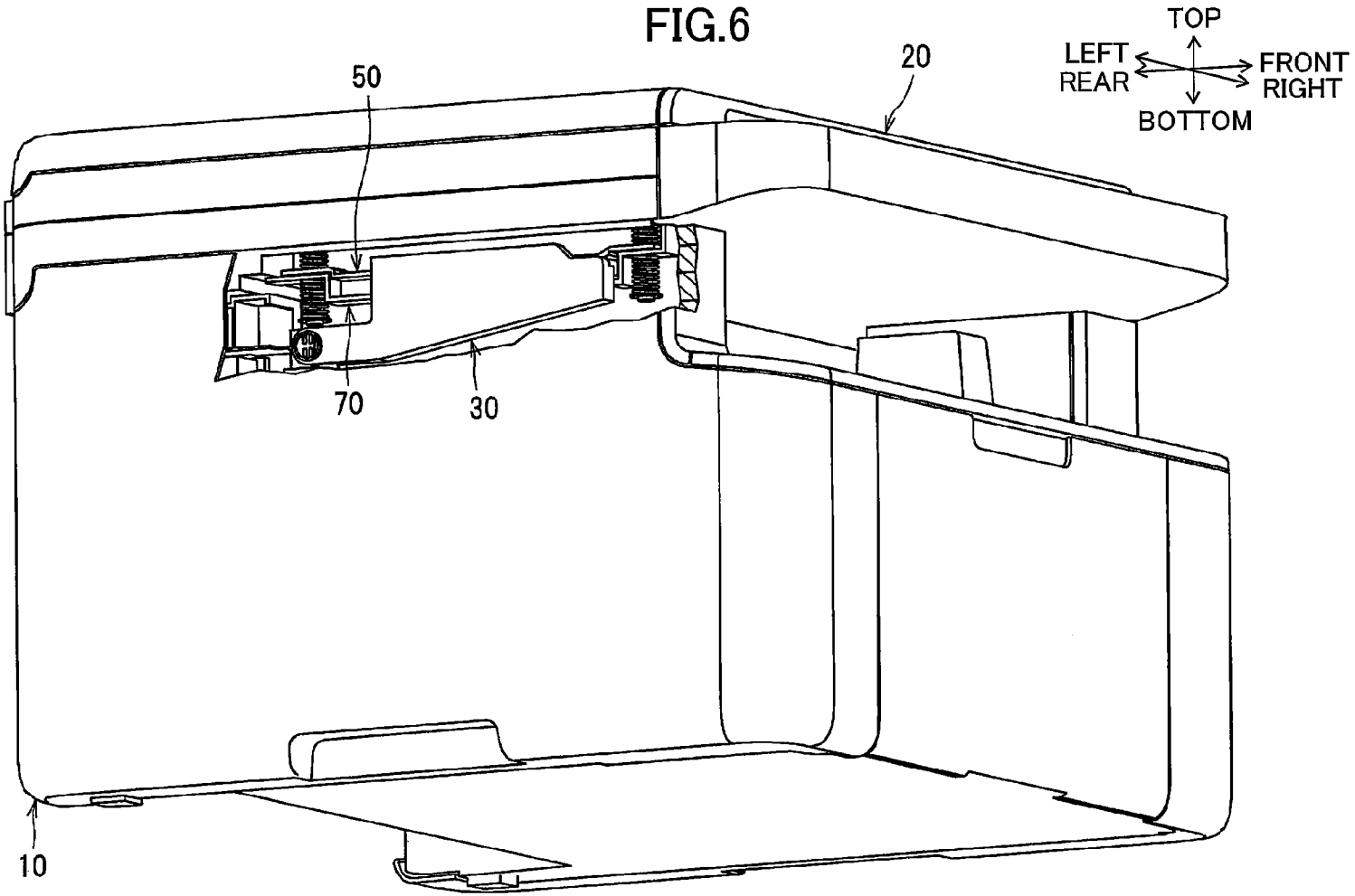
FIG. 6 is a schematic perspective view of an image forming apparatus according to a first modification of the preferred embodiment of the present invention.
Figure 7:
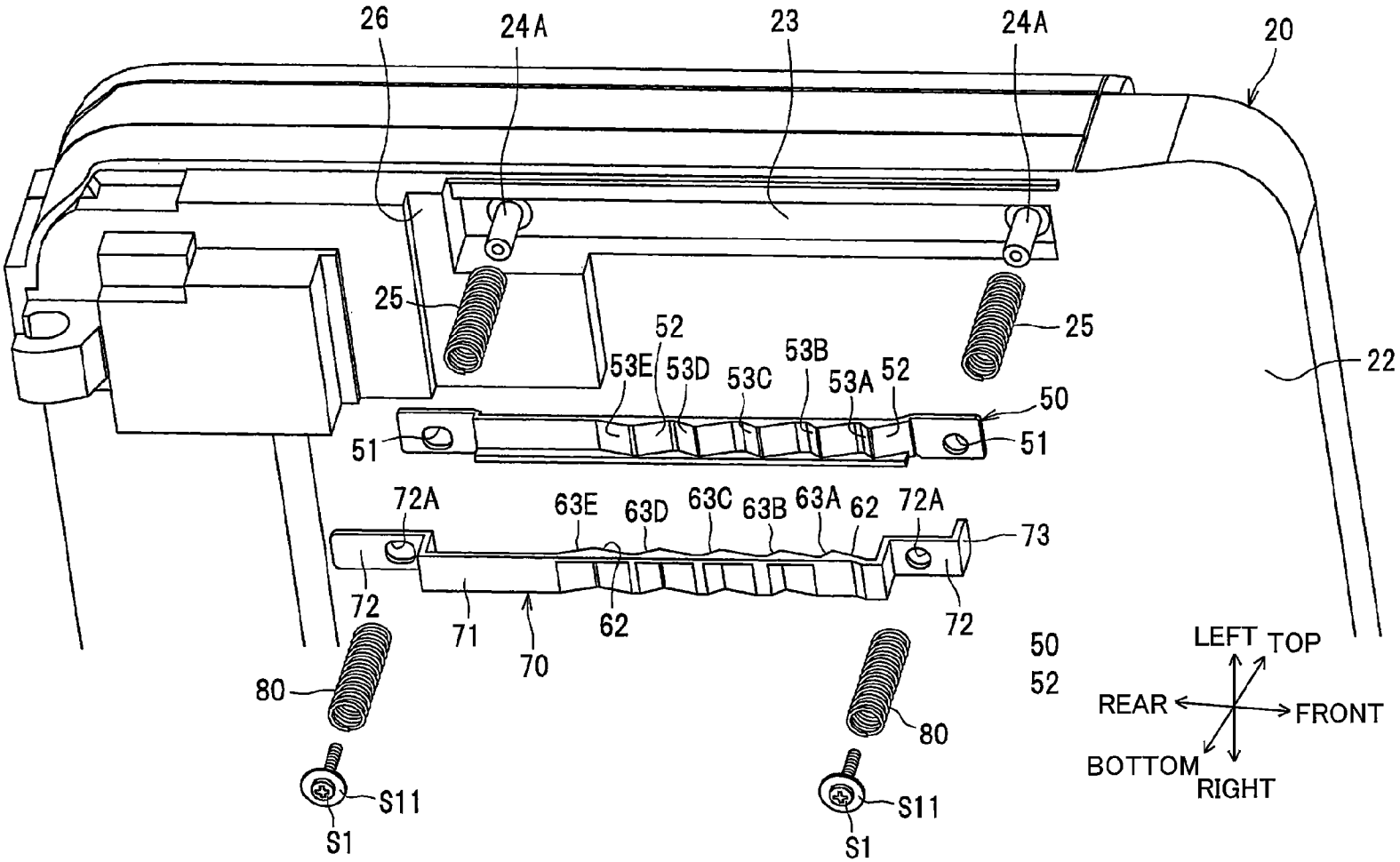
FIG. 7 is an exploded perspective view of a guide of the image forming apparatus according to the first modification of the preferred embodiment of the present invention.
Figure 8:
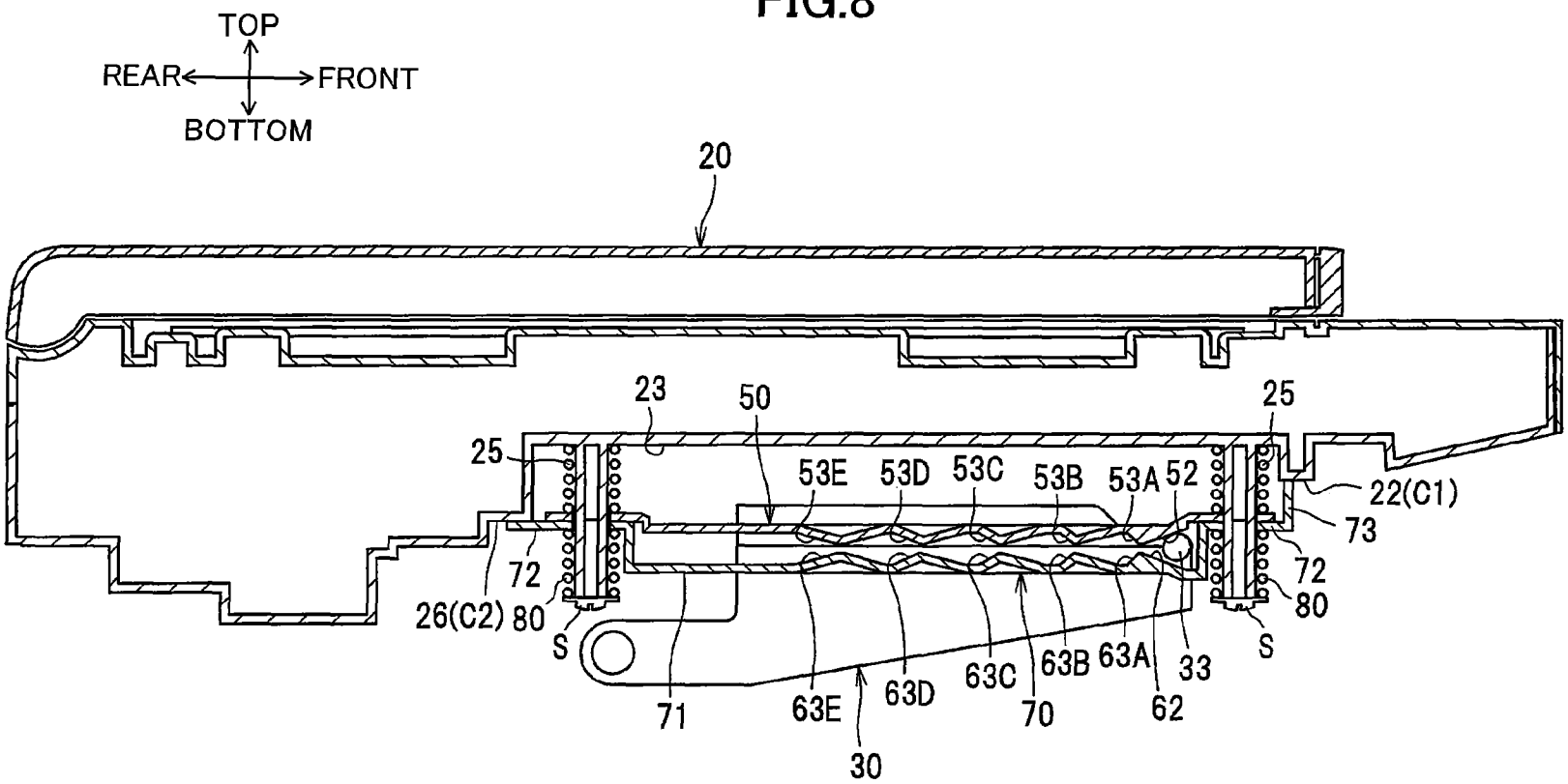
FIG. 8 is a cross-sectional view of the guide and an arm in a state where the top casing is closed according to the first modification of the preferred embodiment of the present invention.

While the second guide 60 is fixed to the top casing 20 in the preferred embodiment, the present invention is not limited to this configuration. The first modification of the preferred embodiment of the present invention is shown in the example of FIGS. 6-8. A second guide 70 is configured to be capable of moving relative to the top casing 20 in the vertical direction (the direction in which the second guide 70 approaches and separates from the first guide 50). By configuring both the first guide 50 and the second guide 70 as movable members, the top casing 20 can pivot more smoothly than when the second guide 60 is fixed to the top casing 20 as in the embodiment described above since the engaging shaft 33 can catch on the fixed second guide 60.

The second guide 70 in FIGS. 6-8 has a long plate-shaped body part 71 that is elongated in the front-rear direction; two first extended parts 72 that have an L-shaped cross section and extend first upward (toward the first guide 50) from the respective front and rear ends of the body part 71, then extend outward in the respective front and rear directions; and a second extended part 73 that extends upward from the front end of the front first extended part 72.

As in the first modification described above, the five first sloped parts 62 and five second sloped parts 63A, 63B, 63C, 63D, and 63E are formed on the body part 71. An engaging hole 72A is formed in each first extended part 72. The bottom surface 23 is provided with a pair of protruding parts 24A. The protruding parts 24A are inserted through the engaging holes 72A, enabling the first extended part 72 to slide vertically along the protruding parts 24A.

Note that the protruding parts 24A in the first modification are formed longer than the protruding parts 24 described in the preferred embodiment and function as second guide support parts that enable the second guide 70 to move in a direction toward or away from the first guide 50. In other words, the protruding parts 24A integrally function as support parts for movably supporting the first guide 50, and support parts for movably supporting the second guide 70, achieving a simpler structure than one that has separate support parts for the first and second guides.

Screws S1 having respective flange parts S11 with a larger diameter than the outer diameter of the protruding parts 24A are screwed into the distal ends of the protruding parts 24A. The screws S1 are respectively inserted through second guide coil springs 80 (as an example of a second guide urging member) the engaging holes 72A, the through-holes 51, and the coil springs 25 before being screwed into the protruding parts 24A. At this time, the second guide coil springs 80 are in a prescribed compressed state between the corresponding first extended parts 72 and the flange parts S11 so that the second guide coil springs 80 urge the second guide 70 toward the first guide 50.

As shown in FIG. 8, casing-side restricting members C1 and C2 are provided on the top casing 20 for restricting movement of the second guide 70. More specifically, the casing-side restricting member C1 is a portion on the bottom surface 22 of the top casing 20 that contacts the top end of the second extended part 73 constituting the second guide 70. The casing-side restricting member C2 is an expanded part 26 that expands further downward than the bottom surface 22 of the top casing 20 and contacts the rear end of the rear first extended part 72.

While the casing-side restricting members C1 and C2 restrict upward movement of the second guide 70, the first extended parts 72 of the second guide 70 function as restricting members for restricting downward movement of the first guide 50 by contacting both ends of the same. Using the second guide 70 to restrict movement of the first guide 50 in this way achieves a simpler structure than one that provides separate restricting members on the top casing for restricting movement of each guide individually, for example.

Figure 9:
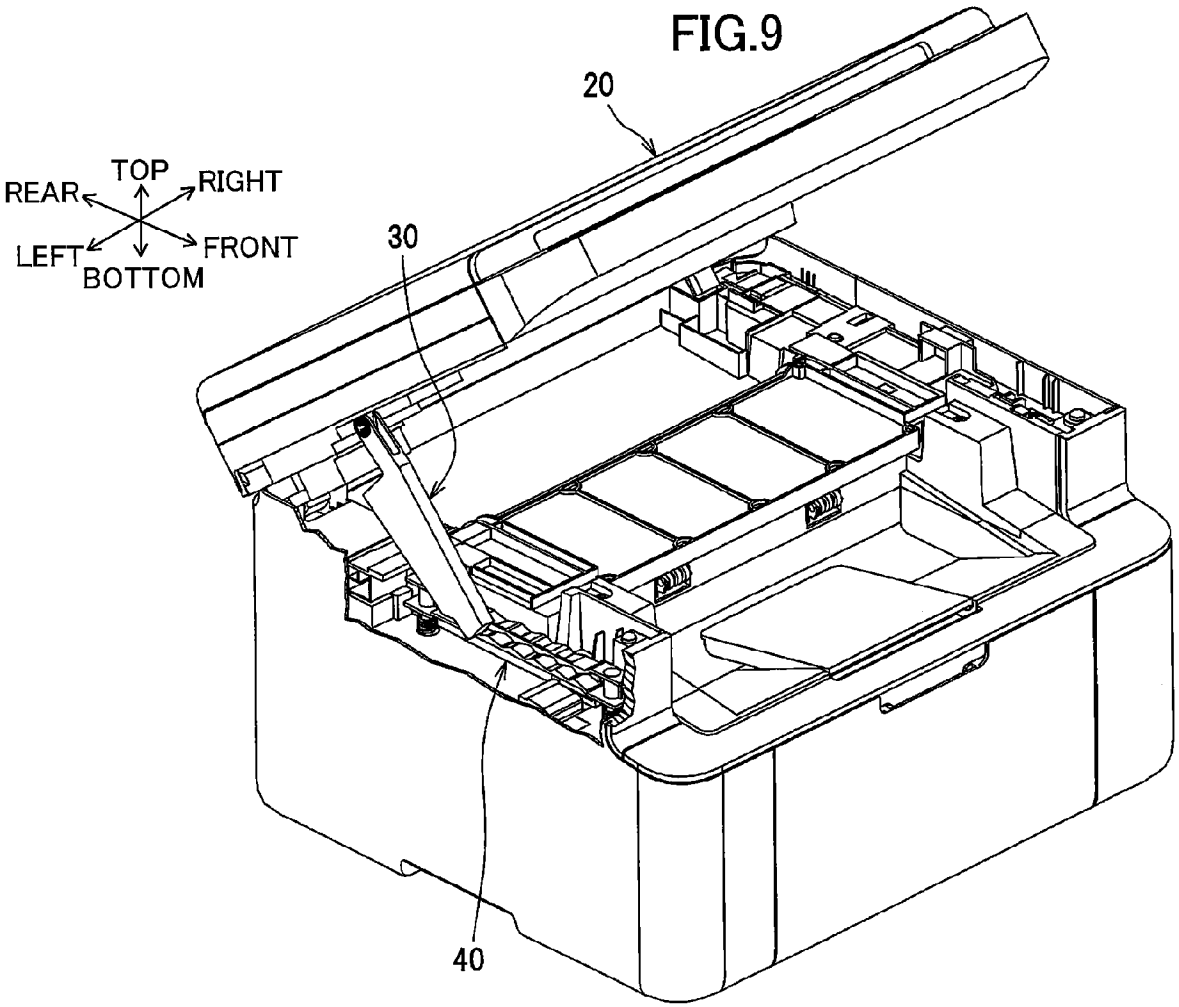
FIG. 9 is a schematic perspective view of an image forming apparatus in a state where a top casing is open according to a second modification of the preferred embodiment of the present invention.

In the preferred embodiment, the arm 30 is rotatably provided on the main casing 10, and the guide unit 40 is provided on the top casing 20, but the present invention is not limited to this configuration. For example, the arm 30 may be rotatably provided on the top casing 20, and the guide unit 40 may be provided on the main casing 10 according to a second modification of the preferred embodiment, as illustrated in FIG. 9.

In the preferred embodiment, the angles of the second sloped parts 53A and 63A grow gradually larger from the rear side to the front side, but the settings for these angles are arbitrary, provided that the forwardmost second sloped parts have a larger angle than the rearmost second sloped parts. In any case, the force of resistance applied by the second sloped parts to the engaging shaft is greater when the top casing is lowered all the way to the closed state than when the top casing begins to be lowered from the uppermost position, thereby preventing the top casing from impacting the main casing with great force.

In the preferred embodiment, the first sloped parts 52 and 62 and the second sloped parts 53A, 63A, . . . , 53E, and 63E are provided on both the first guide 50 and the second guide 60. However, first and second sloped parts may be provided on just one of the first and second guides instead.

In the preferred embodiment, the main casing 10 having the discharge tray 11 on its top surface is used as an example of a first casing, while the top casing 20 housing the original-reading mechanism is used as an example of a second casing, but the present invention is not limited to this configuration. For example, the second casing may be the top cover of a printer having a discharge tray on its top surface, while the first casing is the printer body that pivotably supports the top cover.

In the preferred embodiment, cylindrically shaped protruding parts 24 and 24A are used as an example of the support parts and the second guide support parts, but the present invention is not limited to this configuration. For example, each type of support part may be configured of a polygonal protruding part or a groove. Further, the support parts and the second guide support parts may have separate configurations.

In the preferred embodiment, the coil springs 25 and 80 are used as examples of urging members and second guide urging members, respectively. However, each type of urging member may be configured of leaf springs, wire springs, or elastic rubber members, for example.

While five sloped parts are provided in the preferred embodiment, the number of sloped parts is arbitrary and the present invention is not limited to this number.

While the present invention is applied to the multifunction peripheral 1 in the preferred embodiment, the invention may be applied to another type of image forming apparatus, such as a photocopier, printer, and the like.

What is claimed is:

1. An image forming apparatus comprising:

a first casing;

a second casing supported on the first casing and configured to pivot relative to the first casing;

an arm having a first end portion rotatably coupled to one of the first casing and the second casing and a second end portion slidably coupled to the other of the first casing and the second casing, the second end portion having a shaft;

a guide unit provided at the other of the first casing and the second casing and configured to slidably guide the shaft, the guide unit including a first guide and a second guide provided at a position opposite to the first guide relative to the shaft;

a support part supporting the first guide such that the first guide is movable toward and away from the second guide; and an urging member configured to urge the first guide toward the second guide.

2. The image forming apparatus according to claim 1, wherein the first guide has a hole, and wherein the support part protrudes from the other of the first casing and the second casing and is inserted into the hole.

3. The image forming apparatus according to claim 2, wherein the urging member comprises a coil spring provided around and supported on the support part.

4. The image forming apparatus according to claim 3, wherein the second guide is fixed to the other of the first casing and the second casing.

5. The image forming apparatus according to claim 4, wherein the second guide includes a restricting part configured to restrict movement of the first guide, the restricting part being fixed to a distal end of the support part.

6. The image forming apparatus according to claim 5, wherein the second guide includes .a cylindrical portion protruding toward the first guide and including an end face portion fixed to the distal end of the support part, the end face portion serving as the restricting part.

7. The image forming apparatus according to claim 1, wherein the second casing is configured to pivot between a close position and a remote position farther from the first casing than the close position, the shaft being guided by the guide unit to slide in a first direction when the second casing pivots from the close position to the remote position, the shaft being guided by the guide unit to slide in a second direction opposite to the first direction when the second casing pivots from the remote position to the close position, wherein at least one of the first guide and the second guide includes:

at least one first sloped part sloping in a direction for narrowing a gap between the first guide and the second guide toward downstream in the first direction, the at least one first sloped part sloping at a first acute angle relative to the first direction; and at least one second sloped part sloping in a direction for narrowing a gap between the first guide and the second guide toward downstream in the second direction, the at least one second sloped part sloping at a second acute angle relative to the second direction, and wherein the second acute angle is larger than or equal to the first acute angle.

8. The image forming apparatus according to claim 7, wherein the at least one first sloped part comprises a plurality of first sloped parts and at least one second sloped part comprises a plurality of second sloped parts, the plurality of second sloped parts including a downstream sloped part located most downstream in the second direction and sloping relative to the second direction at a third acute angle, and an upstream sloped part located most upstream in the second direction and sloping relative to the second direction at a fourth acute angle, and wherein the third acute angle is larger than the fourth acute angle, and the fourth acute angle is larger than or equal to the first acute angle.

9. The image forming apparatus according to claim 8, wherein the plurality of second sloped parts comprises three or more second sloped parts sloping relative to the second direction at acute angles which gradually increase toward downstream in the second direction.

10. The image forming apparatus according to claim 1, further comprising:

a second guide support part supporting the second guide such that the second guide is movable toward and away from the first guide; and a second guide urging member configured to urge the second guide toward the first guide.

11. The image forming apparatus according to claim 10, wherein the first guide has a first hole, and the second guide has a second hole, and wherein the support part and the second guide support part are integrally formed with each other, and are inserted into the first hole and the second hole.

12. The image forming apparatus according to claim 10, wherein the other of the first casing and the second casing includes a casing-side restricting part configured to restrict movement of the second guide, and wherein the second guide includes a restricting part configured to restrict movement of the first guide.

13. The image forming apparatus according to claim 1, wherein the guide unit is configured to guide the shaft of the arm along a guiding direction when the second casing pivots relative to the first casing, and the guiding direction crosses an urging direction in which the urging member is configured to urge the first guide toward the second guide.

14. The image forming apparatus according to claim 1, wherein the guide unit is configured to guide the shaft of the arm along a guiding direction when the second casing pivots relative to the first casing, and wherein at least one of the first guide and the second guide includes a plurality of first sloped parts sloping relative to the guiding direction and a plurality of second sloped parts sloping relative to the guiding direction, the first sloped parts and the second sloped parts being arranged in an alternating manner along the guiding direction, and each of the first sloped parts and a corresponding one of the second sloped parts meet at an angle to form a corner.

* * * * *